US006564759B2

(12) United States Patent
Aljabari

(10) Patent No.: US 6,564,759 B2
(45) Date of Patent: May 20, 2003

(54) INJECTION PORT FOR INTERNAL COMBUSTION ENGINE

(75) Inventor: Samer Aljabari, Charlotte, NC (US)

(73) Assignee: Homelite Technologies, Inc., Hamilton (BM)

( * ) Notice: Subject to any disclaimer, the term of this patent is extended or adjusted under 35 U.S.C. 154(b) by 60 days.

(21) Appl. No.: 09/941,379

(22) Filed: Aug. 28, 2001

(65) Prior Publication Data

US 2003/0041817 A1 Mar. 6, 2003

(51) Int. Cl.[7] ..... F02B 75/02
(52) U.S. Cl. ..... 123/65 P; 123/73 C
(58) Field of Search ..... 123/65 P, 73 C, 123/74 R

(56) References Cited

U.S. PATENT DOCUMENTS 4,671,219 A * 6/1987 Ooyama et al. ..... 123/65 P
4,815,420 A * 3/1989 Bartsch ..... 123/65 P
5,503,119 A 4/1996 Glover ..... 123/73 B
6,016,776 A * 1/2000 Jonsson ..... 123/65 P
6,408,805 B2 * 6/2002 Uenoyama et al. ..... 123/65 P

* cited by examiner

*Primary Examiner*—Marguerite McMahon
(74) *Attorney, Agent, or Firm*—Harrington & Smith, LLP

(57) ABSTRACT

An internal combustion engine having a cylinder with a piston movement area; a piston movably mounted in the cylinder; an ignition system connected to the cylinder; and a fuel delivery system connected to the cylinder. The fuel delivery system has a combined fuel and air injection port extending into the cylinder. The injection port has an end at the piston movement area with a top surface and a different shaped bottom. The bottom surface has an inwardly tapering shape to form a bottom portion of the end of the injection port with a generally semi-conical shape.

19 Claims, 4 Drawing Sheets

INJECTION PORT FOR INTERNAL COMBUSTION ENGINE

BACKGROUND OF THE INVENTION

1. Field of the Invention

The present invention relates to internal combustion engines and, more particularly, to a fuel and air mixture injection port for an internal combustion engine.

2. Brief Description of Prior Developments

Small two-stroke engines have many desirable characteristics including: simplicity of construction, low cost of manufacturing, high power-to-weight ratios, high speed operational capability and, in many parts of the world, ease of maintenance with simple facilities. U.S. Pat. No. 5,503,119 discloses a crankcase scavenged two-stroke engine wherein fuel is deposited in a transfer passage between the crankcase and a combustion chamber of the cylinder. Deere & Company manufactures and sells a new type of small two-stroke engine which uses an accumulator to deliver fuel directly into a combustion chamber of the engine. Because a majority of the fuel is not passed through the crankcase of the engine before it enters the combustion chamber, delivery of the fuel to the combustion chamber can be relatively precisely controlled to minimize production of pollutants by having a much more complete burn in the combustion chamber.

One problem that can arise in this type of new relatively precise fuel delivery system is that, at a cold starting condition, the engine can exhibit a very lean running behavior. The engine can suffer from poor warm-up characteristics presented in a bucking (severe misfiring) behavior during warm-up while the carburetor is set at a part-choke position, and thus require a prolonged warm-up time. The bucking behavior of the engine during warm-up is a result of what would be described as a very lean air/fuel mixture.

The air/fuel mixture during cold start appears to be well above the stocichiometric level. This is not due to either a failure in the carburetor delivery system or a failure in the engine induction behavior. The induction passage provides a wide path for the fuel to be injected upward into the combustion chamber. Poor atomization of the fuel can result in large droplet sizes; which are more difficult to burn. Thus, when the engine is cold, a smaller percentage of the fuel delivered is burnt with the available air resulting in what appears to be a lean engine. As the engine warms up, fuel vaporizes resulting in smaller droplet sizes. The air/fuel mixture with the smaller droplet sizes begins to approach the proper level.

There is a desire to refine the injector design to improve fuel atomization under all conditions; especially a cold start condition. The engine could die on the non-choke position if not properly warmed-up on the part-choke position. The warm-up period could be well over a minute in most cases. That characteristic is very undesirable by consumers since it could incorrectly reflect a poor quality engine. There is a desire to eliminate this type of behavior. There is a desire for a new type of fuel injector port configuration which can better atomize fuel injected into a combustion chamber from an accumulator at cold engine start-up, thereby resulting in better burning process. This, in turn, can eliminate the bucking behavior during startup or warm-up time.

SUMMARY OF THE INVENTION

In accordance with one aspect of the present invention, an internal combustion engine is provided having a cylinder with a piston movement area; a piston movably mounted in the cylinder; an ignition system connected to the cylinder; and a fuel delivery system connected to the cylinder. The fuel delivery system has a combined fuel and air injection port extending into the cylinder. The injection port has an end at the piston movement area with a top surface and a different shaped bottom surface. The bottom surface has an upwardly tapering shape to form a bottom portion of the end of the injection port with a generally semi-conical shape.

In accordance with another aspect of the present invention, an internal combustion engine is provided having a cylinder, a piston movably mounted in the cylinder, an ignition system connected to the cylinder, and a fuel delivery system for delivering fuel into the cylinder. The fuel delivery system includes a fuel and air injection port through the cylinder. The injection port has a substantially straight circular cross section along a majority of its length and a curved tapering surface along its bottom side at an exit from the injection port into the cylinder.

In accordance with one method of the present invention, a method of manufacturing a cylinder for an internal combustion engine is provided comprising steps of providing a cylinder member with a piston movement area; forming a channel through the cylinder member up to an inner wall of the cylinder at the piston movement area, an end of the channel proximate the inner wall having a general conical shape; and removing an upper portion of the general conical shape at the end of the channel to form an injection port exit into the piston movement area of the cylinder member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
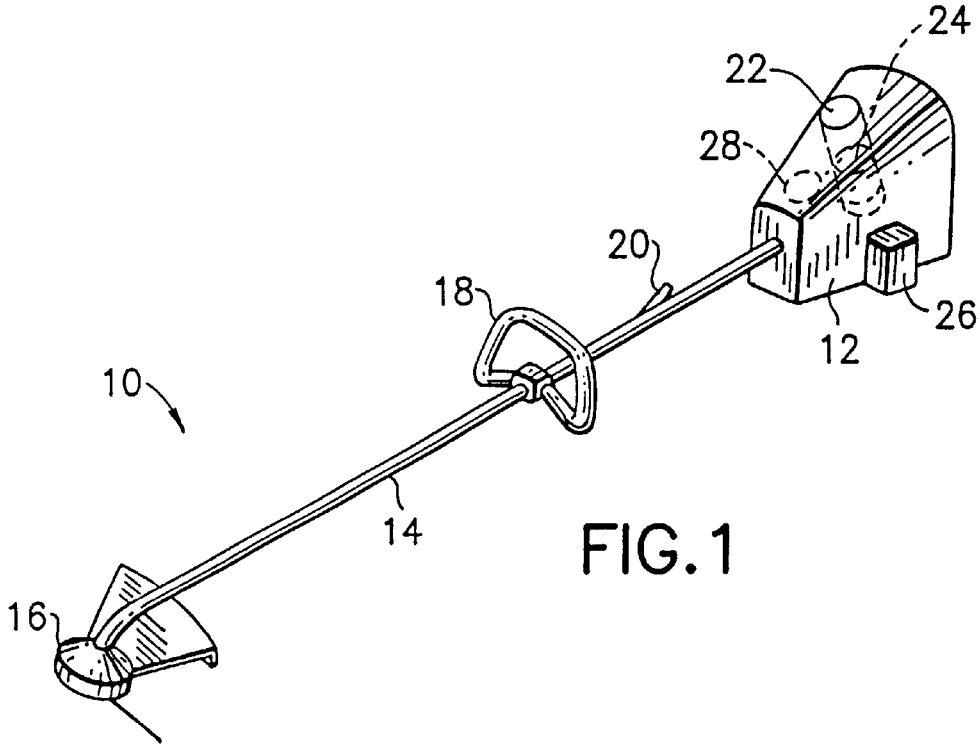
FIG. 1 is a schematic perspective view of a tool having an engine incorporating features of the present invention.

Referring to FIG. 1, there is shown a perspective view of a power tool 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The power tool 10, in the embodiment shown, is a string trimmer. However, in alternate embodiments, features of the present invention could be used in any suitable type of tool or device which is powered by an internal combustion engine. For example, features of the present invention could be incorporated into a chain saw, a hedge trimmer, a motorcycle or moped, or a motorboat outboard engine.

The string trimmer 10 generally comprises an internal combustion engine 12, a shaft 14, a string trimmer head 16, a handle 18 and a throttle trigger or control 20. In an alternate embodiment, features of the present invention could be used in any suitable type of string trimmer having an internal combustion engine. The engine 12 generally comprises a cylinder 22, a piston 24, a fuel delivery system 26, and an ignition system 28. The engine could comprise additional components. The engine 12 can be similar to the engines described in U.S. patent application Ser. No. 09/518,578, assigned to the same assignee as herein, which is hereby incorporated by reference in its entirety. The engine could also be similar to the engines described in U.S. patent application Ser. Nos. 09/138,244; 09/504,056; 09/533,752; 09/589,508; and 09/588,882.

Figure 2:
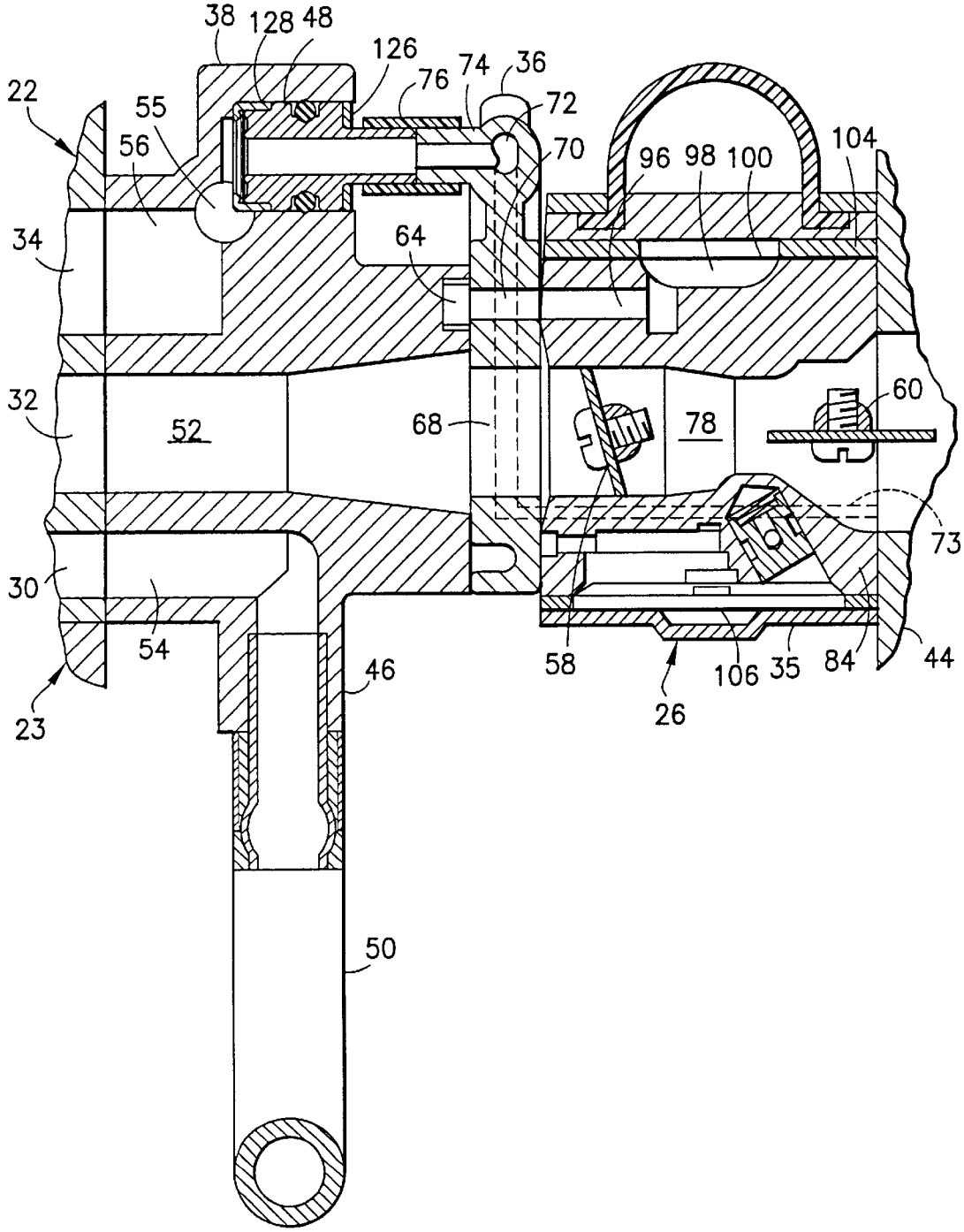
FIG. 2 is a partial cross sectional view of components of the engine in the tool shown in FIG. 1.

Referring also to FIG. 2, portions of the cylinder 22 and the fuel delivery system 26 are shown. A side of the cylinder 22 includes three apertures 30, 32 and 34. The bottom aperture 30 can be in selective communication with the crankcase of the engine. In a preferred embodiment, the bottom aperture 30 can be selectively opened and closed by the piston 24 as the piston moves towards and away from its bottom dead center position. The middle aperture 32 is a main air entrance for air to enter the crankcase of the engine. The middle aperture 32 is selectively opened and closed by the piston as the piston moves in the cylinder. The top aperture 34 is a fuel and air mixture entrance aperture or injection port. The top aperture 34 can also be selectively open and closed by the piston as the piston moves towards and away from its top dead center position. In the embodiment shown, the three apertures 30, 32 and 34 are aligned one above the other. However, in alternate embodiments, the three apertures could be offset relative to each other.

The fuel delivery system 26 is preferably the same or very similar to the system described in U.S. patent application Ser. No. 09/518,578. The fuel delivery system generally comprises a carburetor unit 35. In this embodiment the carburetor unit 35 includes a carburetor adapter plate 36. A combined heat dam and accumulator assembly 38 connects the carburetor unit 35 to the cylinder 22 and crankcase 23 of the engine. An air filter 44 is connected to an outward side of the carburetor unit 35.

The combined heat dam and accumulator assembly 38 generally comprises a frame 46, a check valve 48, and an accumulator tube 50. The frame 46 comprises a main air inlet channel 52, two conduit sections 54, 55 and an inlet 56. The main air inlet channel 52 is connected to the inlet 32. The bottom conduit section 54 is connected to the port 30. The top conduit section 55 is connected to the inlet 56 which is connected to the port 34 into the combustion chamber of the cylinder 22. The tube 50 connects the two conduit sections 54, 55 to each other.

The check valve 48 has an exit into the top conduit section 55. The check valve 48 allows fuel and air to be sucked into the accumulator channel 55 and tube 50 by suction from the crankcase applied at port 30, but substantially prevents hot combustion gases from the cylinder from passing through the check valve 48. The check valve 48 also substantially prevents the fuel/air charge in the accumulator from re-entering back into the check valve 48. The frame 46 also includes three mounting holes for use with fasteners (not shown) to attach the assembly 38 to mounting holes 39 of the cylinder 22 (see FIG. 3). The channel 64 communicates with crankcase pressure through a hole (not shown) connected to hole 67 in the cylinder 22 (see FIG. 3).

The adapter 36 includes a pass-through flow hole 68, a pressure pass-through hole 70, and a channel 72 which extends into a post 74. The main flow channel 68 is aligned with the main channel 52 of the combined heat dam and accumulator assembly 38. The pressure pass-through hole 70 is aligned with the top of the channel 64 on the outward side of the assembly 38. The channel 72 is connected to the check valve 48 at one end by the post 74 and a small piece of tube 76. The entrance into the channel 72 is aligned with a small air flow channel 73 from the carburetor unit 35. The main flow channel 68 is also aligned with the main air flow channel 78.

The inward facing side of the carburetor unit 35 is located against the outward facing side of the adapter 36. The outward facing side of the carburetor unit 35 has the air filter 44 located against it. The fuel pump 104 is located at the top of the frame 84. A fuel inlet connector connects a fuel line (not shown) from the gasoline tank (not shown) to the fuel pump 104. The fuel pump is preferably a diaphragm driven pump which is driven by crankcase pressures. However, any suitable fuel pump could be provided. An internal conduit (not shown) through the frame 84 supplies fuel from the pump 104 to the fuel meter 106. The fuel meter 106 is connected to the bottom of the frame 84.

The carburetor unit 35 preferably includes two fuel mixture needle screws connected to the frame 84 and intersecting fuel conduits (not shown). The fuel conduits extend past the needle screws to the air flow channels 73, 78. The frame 84 includes a channel 96 from the inward side of the frame 84 into the chamber 98 of the pump 104. Channels 96, 70, 64 and another (not shown) connect the chamber 98 to crankcase pressure in the crankcase 23 for driving the diaphragm 100 of the pump 104.

The frame 84 has a throttle shaft hole. The throttle shaft hole extends through the two air flow channels 78, 73, and also through a portion of an air bleed channel (not shown) and a portion of a channel that forms an accelerator pump (not shown). The throttle shaft assembly 58 generally comprises a shaft, a throttle plate, a spring and a control lever. The control lever is preferably connected by a control cable to the user actuated throttle trigger 20 (see FIG. 1). The spring biases the throttle shaft assembly at an idle position. The throttle plate is fixedly attached to the shaft and located in the main air channel 78. The throttle shaft includes two through-holes and a cut-out section. In a preferred embodiment the shaft also has an annular groove at the first through-hole. In a preferred embodiment O-ring seals are provided between the frame and the shaft on opposite sides of the groove.

In the idle position shown, the shaft blocks the accelerator pump channel and a portion of the air bleed channel and substantially blocks the small air flow channel (allowing a small amount of air and fuel to pass through a groove). The plate partially restricts air and fuel from passing through the channel 78. The throttle plate is moved to an open position to allow more air to pass through the channel 78 and which also reduces the suction force on the fuel conduit thereby having less fuel enter the channel 78 at wide open throttle than at idle. The fuel entering the channel 78 at wide open throttle is primarily used for lubrication of components in the crankcase and not for combustion. Thus, the channel 78 is not substantially used as a carburetor during wide open throttle, but primarily as an air inlet and lubricant supply conduit.

Throttle shaft assembly 58 can be used with the channel 78 at wide open throttle primarily as an air throttle; not a fuel/air throttle. This could also be true at idle if almost all the fuel is delivered by the accumulator and other air channel 73 at idle. However, if the fuel for combustion at idle is delivered by the larger channel 78, it is preferred to allow at least some air and fuel to pass through the smaller channel 73 at idle in order to keep the smaller fuel supply system to the accumulator in a wet condition or state.

The frame 84 includes a choke shaft hole. The hole passes through the two channels 73, 78, and a portion of the air bleed channel. The choke shaft assembly 60 generally comprises a shaft, a choke plate, and a user actuated control lever or handle. The choke plate is located in the main channel 78. The shaft assembly 60 is rotatable about 75° between the choke position and the non-choke position. The choke shaft has the choke plate fixedly attached to it and also comprises two through-holes. As the choke shaft is rotated between its choke and non-choke positions, the first hole is misaligned with and aligned with the smaller channel 73, respectively. Likewise, as the choke shaft is rotated between its choke and non-choke positions, the second hole is misaligned with and aligned with the portion of the air bleed channel (not shown). Thus, the choke shaft assembly 60 can open and block the air bleed channel as well as choke the two air channels 73, 78. The shaft preferably has an annular groove around the shaft at the hole such that a small amount of air can pass through the groove when the choke shaft assembly is in a choke position. In alternate embodiments, any suitable type of carburetor could be used.

Figure 3:
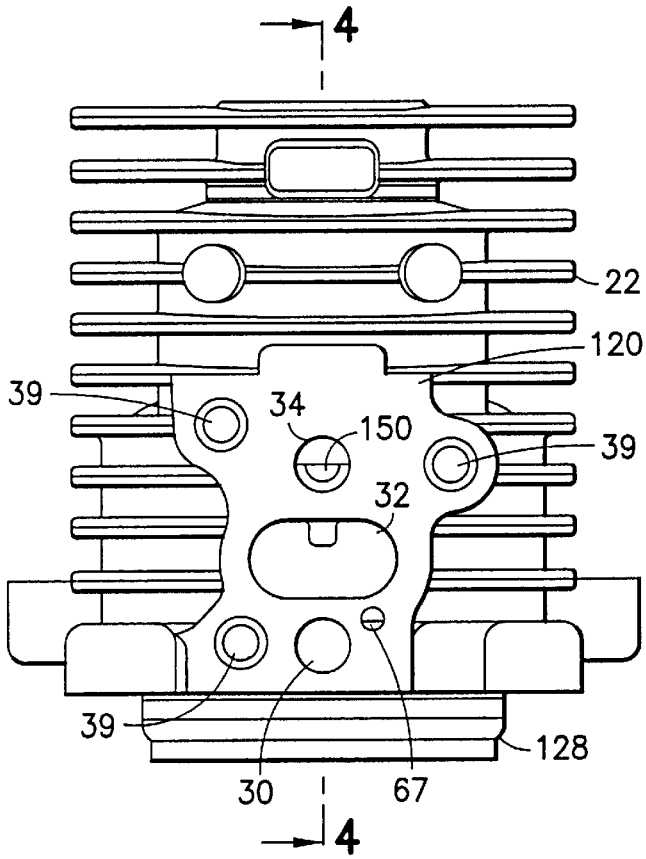
FIG. 3 is a side elevational view of the cylinder of the engine shown in FIG. 1.
Figure 4:
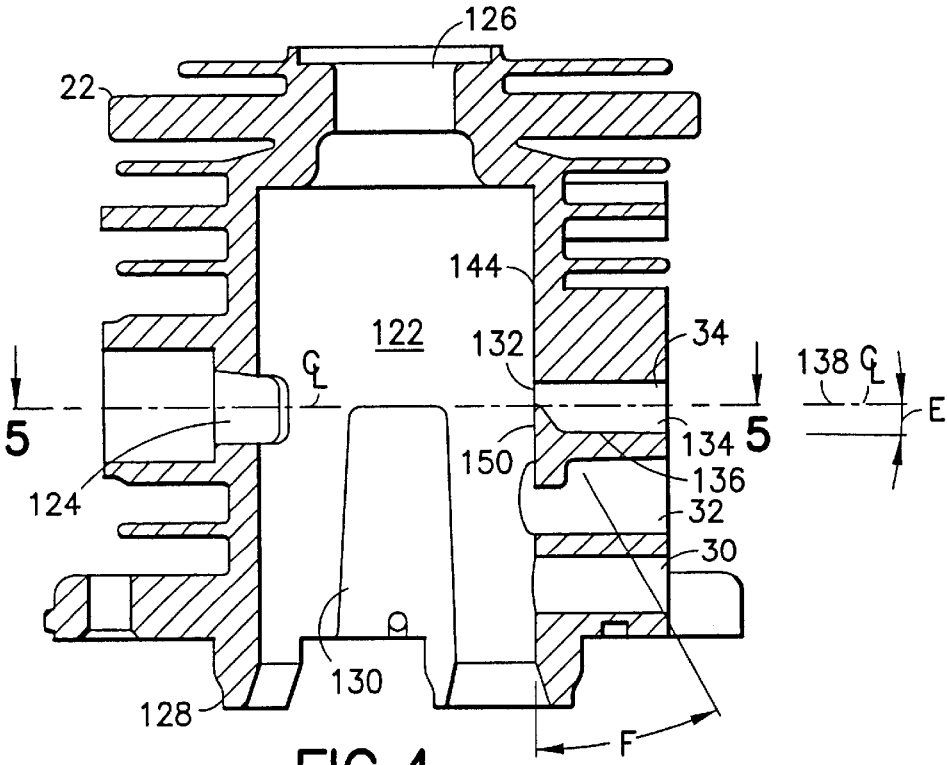
FIG. 4 is a cross sectional view of the cylinder shown in FIG. 3 taken along line 4—4.
Figure 5:
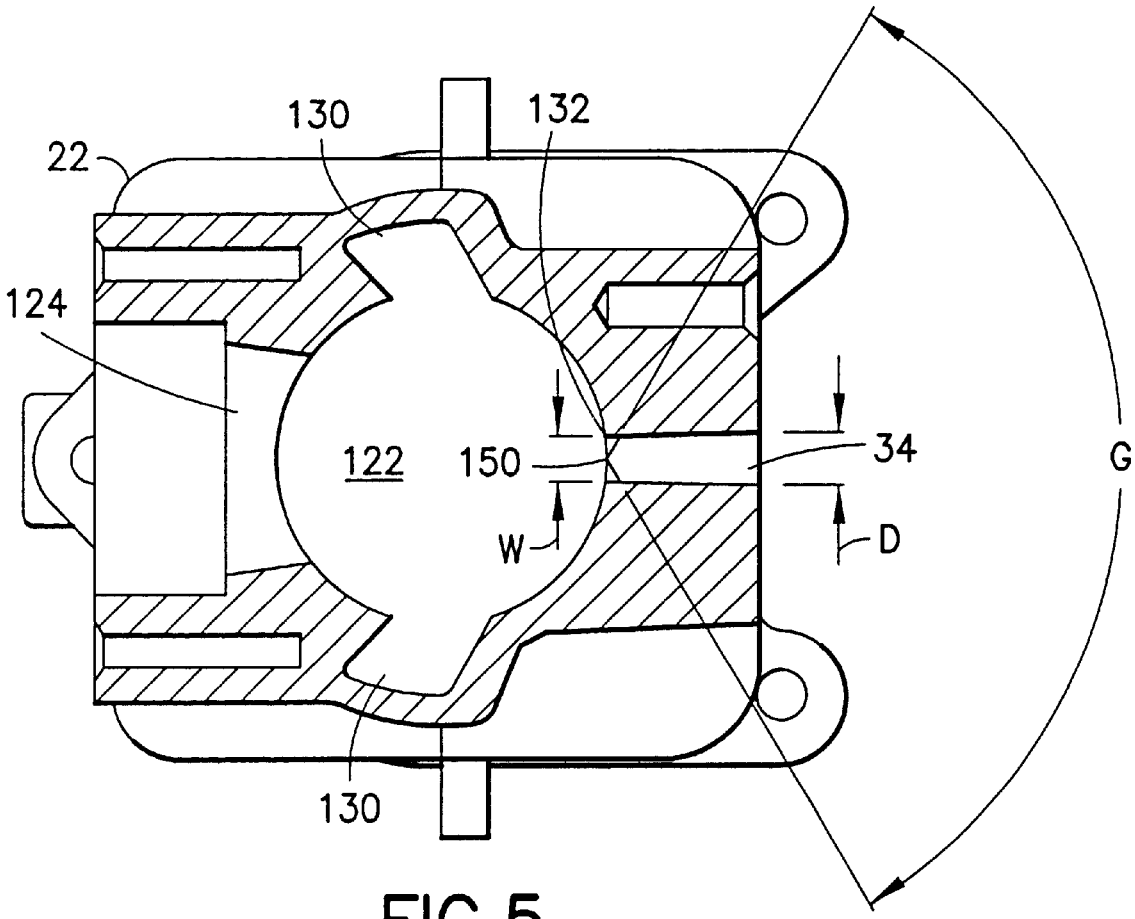
FIG. 5 is a cross sectional view of the cylinder shown in FIG. 4 taken along line 5—5.

Referring now to FIGS. 3–5, the cylinder 22 of the engine has a side with a mounting area 120 which the assembly 38 is mounted to. The three apertures 30, 32 and 34 extend through the area 120 into a piston movement area 122 of the cylinder 22. The cylinder 22 includes an exhaust port 124 located on an opposite side from the apertures 30, 32 and 34. The cylinder 22 also includes a spark plug mounting area 126 at a top end of the cylinder. A bottom end 128 of the cylinder 22 is adapted to be mounted to the crankcase 23. The cylinder 22 also includes transfer channels 130 along sides of the piston movement area 122.

The fuel and air mixture injection port 34 comprises a relatively straight channel 134 along a majority of its length. However, an end 132 of the injection port 34, leading into piston movement area 122, is partially closed with a unique lead-in configuration. In the embodiment shown, the channel 134 has a starting diameter D of about 6.35 mm. However, the channel could have any suitable size starting diameter, or the channel could have any suitable type of the shape rather than cross sectional round. In a preferred embodiment, the bottom side 136 of the channel 134 is angled relative to the center line axis 138 of the channel at an angle E of about 2°. However, in alternate embodiments, the angle E could be any suitable type of angle. Alternatively, the bottom surface 136 might not be angled or could have any suitable type of shape.

Figure 6:
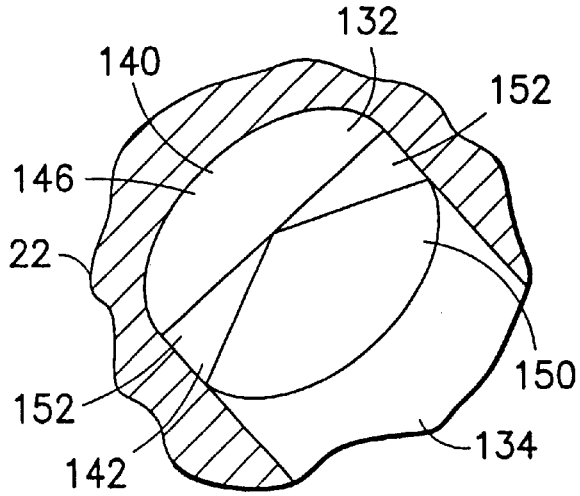
FIG. 6 is a cross sectional perspective view of the end of the injection port channel in the cylinder shown in FIGS. 3–5.

Referring also to FIG. 6, the end 132 of the injection port 34 comprises a top portion 140 and a bottom portion 142. The top portion 140 has a general semicircular shaped aperture 146 extending from the channel 134 through the inner wall 144 of the cylinder 22 into the piston movement area 122. However, in alternate embodiments, the aperture 146 and the top portion 140 could comprise any suitable type of shapes.

The bottom portion 142 has a surface which is different from the top surface. The bottom surface comprises a surface 150 facing towards the entrance into the injection port 34. The surface 150 has an inwardly and upwardly tapering shape to form the bottom portion of the end of the injection port with a general semi-conical shaped surface. However, in alternate embodiments, the bottom portion of the end of the injection port could have any suitable type of shape. The inwardly tapering surface 150 is angled at an angle F of about 30° relative to the inner wall 144. Thus, the surface 150 is angled at an angle of about 60° relative to the longitudinal axis 138 of the channel 134 forming the injection port. This produces an angle G between opposite sides of the surface 150 of about 120°. However, in alternate embodiments, the angle F could be any suitable type of angle. Alternatively, the shape of the surface 150 at the end 132 could have any suitable type of shape.

The bottom portion 142 extends a distance upward in the port 34 which is equal to about half the width W of the aperture 146. In a preferred embodiment, the width W is about 5.43 mm. However, in alternate embodiments, the width W could have any suitable size. Thus, the end of the bottom portion 142 occupies about half the height of the port at its exit into the piston movement area 122. The top surface of the bottom portion 142 has a flat shape comprising two general mirror shaped triangles 152; although the sides at the inner wall 144 are slightly curved. In an alternate embodiment the top surface of the bottom portion 142 could comprise any suitable type of shape.

In order to manufacture the cylinder, a cylinder member is provided with a piston movement area. A channel is formed through the cylinder member up to an inner wall of the cylinder at the piston movement area. In a preferred method, the channel is formed when the cylinder member is cast as a cast member. However, in an alternate embodiment, the channel could be formed by drilling a hole in the cylinder member by a drill bit. An end of the channel, proximate the cylinder inner wall, is provided with a general conical shape, such as by the casting mold or due to the conical shape of the front end of the drill bit. The method then comprises removing an upper portion of the general conical shape at the end of the channel to form the injection port exit or aperture into the piston movement area of the cylinder member.

Prototypes were made by drilling a ¼ inch hole up to about 0.020 inch away from the inner wall of the cylinder. Then the upper half circle section of the drilled hole was removed to create the opening of the injection passage leaving the bottom half. This provided the fuel path for fuel to be injected. The new injector design resulted in excellent start ability and warm-up characteristics where bucking was completely eliminated. No detrimental effect was observed on the power characteristics of the engine.

The shape of the injection port 34, and more particularly the shape of the end 132, is relatively inexpensive to manufacture, but can be reproducibly manufactured with very great precision. The shape of the end 132 of the injection port 34 causes the fuel and air mixture passing from the injection port 34 into the piston movement area 122 to be better atomized than previously available with a straight uniform injection port. Thus, the engine does not exhibit a very lean running behavior upon cold starting. The engine does not suffer from poor warm-up characteristics presented in bucking (severe misfiring) behavior during warm-up while the carburetor is set at a part-choke position and, thus, does not require a prolonged warm-up time. With the present invention, when the engine is cold, a larger percentage of the fuel delivered to the combustion chamber is burnt with the available air. Thus, the present invention results in a better burning process during cold start which, in turn, eliminates the bucking behavior during startup and reduces warm-up time.

The present invention improves the carbon monoxide (CO) stability and CO operating range for the engine. Thus, the engine can operate at slower speeds and faster speeds without increasing CO output of the engine past a predetermined preferred range, such as a CO output standard set by a governmental regulation. The present invention provides another advantage. In the prior art, the injector port was cast as a straight hole and an injector insert (also known as a stuffer) was inserted into the injector port to provided a contoured shape. The present invention eliminates the need for a stuffer. Thus, the engine is less expensive to manufacture because a separate stuffer piece is no longer needed and, the engine is easier to manufacture because a step of inserting a stuffer into the injector port in no longer required.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An internal combustion engine comprising:

a cylinder having a piston movement area;

a piston movably mounted in the cylinder;

an ignition system connected to the cylinder; and a fuel delivery system connected to the cylinder, the fuel delivery system comprising a combined fuel and air injection port extending into the cylinder, the injection port having an end at the piston movement area with a top surface and a different shaped bottom surface, wherein the bottom surface comprises an inwardly and upwardly tapering shape to form a bottom portion of the end of the injection port with a generally semi-conical shape.

2. An internal combustion engine as in claim 1 wherein a top portion of the end of the injection port forms a general semicircular shaped aperture.

3. An internal combustion engine as in claim 1 wherein the injection port comprises a substantially straight channel to the bottom portion of the end of the injection port, the substantially straight channel having a generally circular cross section along its length.

4. An internal combustion engine as in claim 1 wherein the tapering shape is angled at an angle of about 60° relative to a longitudinal axis of a channel forming the injection port.

5. An internal combustion engine as in claim 1 wherein the cylinder comprises a main air entrance port located beneath the injection port and a crankcase pressure inlet port located beneath the main air entrance port.

6. An internal combustion engine as in claim 1 wherein the fuel delivery system further comprises an air and fuel mixture accumulator connected to the injection port.

7. An internal combustion engine as in claim 6 wherein the accumulator is selectively connectable to pressure in a crankcase of the engine.

8. An internal combustion engine as in claim 7 wherein the fuel delivery system comprises a carburetor having an outlet connected to the accumulator.

9. In an internal combustion engine having a cylinder, a piston movably mounted in the cylinder, an ignition system connected to the cylinder, and a fuel delivery system for delivering fuel into the cylinder, the improvement comprising:

the fuel delivery system includes a fuel and air injection port through the cylinder, the injection port having a substantially straight circular cross section along a majority of its length and a curved tapering surface along its bottom side at an exit from the injection port into the cylinder.

10. An internal combustion engine as in claim 9 wherein a top side of the injection port at the exit has a general semicircular shape.

11. An internal combustion engine as in claim 9 wherein the injection port comprises a substantially straight channel to the tapering surface, the substantially straight channel having a generally circular cross section along its length.

12. An internal combustion engine as in claim 9 wherein the tapering surface is angled at an angle of about 60° relative to a longitudinal axis of a channel forming the injection port.

13. An internal combustion engine as in claim 9 wherein the cylinder comprises a main air entrance port located beneath the injection port and a crankcase pressure inlet port located beneath the main air entrance port.

14. An internal combustion engine as in claim 9 wherein the fuel delivery system further comprises an air and fuel mixture accumulator connected to the injection port.

15. An internal combustion engine as in claim 14 wherein the accumulator is selectively connectable to pressure in a crankcase of the engine.

16. An internal combustion engine as in claim 15 wherein the fuel delivery system comprises a carburetor having an outlet connected to the accumulator.

17. A method of manufacturing a cylinder for an internal combustion engine, the method comprising steps of:

providing a cylinder member with a piston movement area;

forming a channel through the cylinder member up towards an inner wall of the cylinder at the piston movement area, an end of the channel proximate the inner wall having a general conical shape; and removing an upper portion of the general conical shape at the end of the channel to form an injection port exit into the piston movement area of the cylinder member.

18. A method as in claim 17 further comprising forming a main air inlet in the cylinder member beneath the channel.

19. A method as in claim 18 further comprising forming a crankcase pressure inlet in the cylinder member beneath the main air inlet.

* * * * *